US005556294A

United States Patent [19]

Hofmeister et al.

[11] Patent Number: 5,556,294

[45] Date of Patent: Sep. 17, 1996

[54] ELECTRICAL PLUG CONNECTOR

[75] Inventors: Werner Hofmeister, Muehlacker; Michael Schoenfeld, Leinfelden-Echterdingen, both of Germany

[73] Assignee: Robert Bosch GmbH, Stuttgart, Germany

[21] Appl. No.: 249,862

[22] Filed: May 26, 1994

[30] Foreign Application Priority Data

Jun. 21, 1993 [DE] Germany ..... 43 20 491.0

[51] Int. Cl.[6] ..... H01R 13/52

[52] U.S. Cl. ..... 439/281; 439/271

[58] Field of Search ..... 439/271, 272, 439/273, 278, 280, 281

[56] References Cited

U.S. PATENT DOCUMENTS 4,417,736 11/1983 Herrmann, Jr. ..... 439/281 X
4,527,851 7/1985 Gallusser et al. ..... 439/272 X
4,780,091 10/1988 Shenton ..... 439/272
4,993,964 2/1991 Trummer ..... 439/272

FOREIGN PATENT DOCUMENTS

4115119A1 11/1992 European Pat. Off. .
725662 8/1942 Germany .

*Primary Examiner*—Khiem Nguyen
*Attorney, Agent, or Firm*—Frishauf, Holtz, Goodman, Langer & Chick, P.C.

[57] ABSTRACT

A plug connection with a plug (11) and an associated counterpart plug or socket (12) is intended to be formed such that shaping strains acting upon it have no or only slight disturbing influence on the contacts (25, 28) of the plug connection. To that end, the plug (11) has a packing element (19), supported on its outside in a contact carrier (14), in the form of an uninterrupted, encompassing radial rubber elastic element which, in addition to a framelike basic body (37), engages socket (12), also contains pinlike retaining segments (41), which are oriented inward, press resiliently against the contact elements (25) of the plug (11) and stabilize them in their position. This plug connection is preferably used in motor vehicles, in whose operation strong shaking strains must be expected, e.g. having Diesel engines.

5 Claims, 1 Drawing Sheet

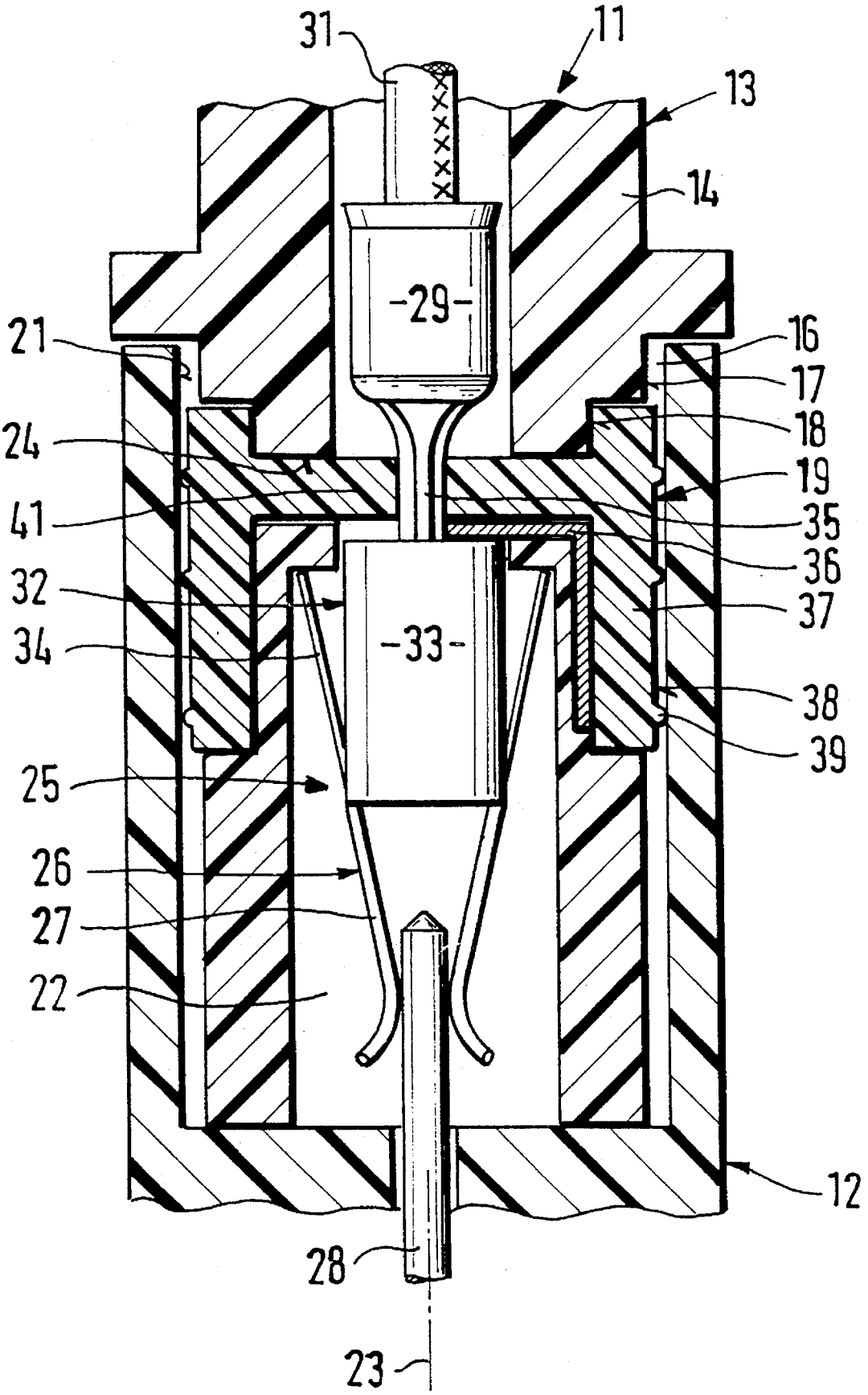
31
11
13
14
-29-
21
16
17
18
24
19
41
35
36
32
37
34
-33-
38
39
25
26
27
22
12
28
23

ELECTRICAL PLUG CONNECTOR

FIELD OF THE INVENTION

The invention relates to an electric plug connection having a packing element which stabilizes the contact elements against vibration.

BACKGROUND

From German Patent Disclosure DE 41 15 119 A1, EPE, describes a watertight electrical plug connection that comprises a plug and a counterpart plug associated with it; it is known to provide receiving chambers in the plug into each of which one contact element, connected to an electric line, is inserted in a disconnectably locked fashion. In the inserted state of the plug connection, to a contact part of the counterpart plug is connected to the contact element.

A packing element, formed as an O-ring, is supported on the plug, spatially separated from the contact elements in a circumferential groove thereof, and when the plug is put together with the counterpart plug, this O-ring rests on an inside face of the counterpart plug that partially encloses the plug and closes the plug connection at this coupling point.

In the presence of accelerations acting upon the plug connection, for instance in the form of shaking motions in operation of a Diesel engine, when the plug is in the plugged-in state, relative motions arise between the contact element and the contact part that is inserted with force in the contact segment formed on the end of the contact element, since the contact element is unsupported by the packing element and the connecting point between the contact element and the contact part can vibrate transversely to the longitudinal direction of these contact members in the context of lateral play in the receiving chamber. As a result, the touching surfaces of the contact element and contact part can rub against one another, and contact is then made via the less-well contacting carrier material of the contact element and contact part, thus impairing the reliability of the contact of the plug connection.

SUMMARY OF THE INVENTION

Briefly, a packing element is specially shaped to support the plug that seals the plug off from a counterpart socket when the plug connection is in the plugged-in state, and that moreover, because of its design, rests on the contact element, so that an additional support is created for the contact element besides the connecting point having the contact part. As a result, compared with a one-point support of the contact element only in the contact part, the relative motion between the contact element and the contact part is reduced, and the contact security of the plug connection is improved thereby.

DRAWING

An exemplary embodiment of the invention is shown in the drawing and described in detail in the following description. The single FIGURE of the drawing is a side view of a plug connection, shown partly cut away.

DETAILED DESCRIPTION OF THE PREFERRED EMBODIMENT

In the exemplary embodiment, a plug 11 is shown in the drawing as part of a plug connection; it is coupled to a counterpart socket 12, likewise shown only in part. The plug

11 has a plug housing 13, which includes a contact carrier 14 made of electrically insulating plastic.

The contact carrier 14 is formed as an approximately block-shaped elongated body, which with the closure of the plug connection engages a matching insertion opening 16 of the counterpart socket 12. A jacket face 17 of the contact carrier 14 includes a notch or groove 18, formed as a circumferential groove, for receiving a packing element 19, which seals relative to the groove 18 and an inner face 21 of the insertion opening 16 of the counterpart socket 12, so that the interior of the plug connection, at the coupling point between the plug 11 and the counterpart socket 12, is sealed off.

A number of receiving chambers 22, corresponding to the number of poles of the plug connection, is formed in the contact carrier 14, located in a row next to one another, and one of which chambers is shown in the drawing. Each chamber is provided with a transverse bore 24, which is formed in the contact carrier 14 in the region of notch 18.

A contact element 25, which is formed as a flat blade bush, is inserted into the receiving chamber 22 and located symmetrically to the longitudinal axis 23.

On its end, the contact element 25 has a contact segment 26 on the one hand, with two spring legs 27 extending symmetrically to the longitudinal axis 23 for receiving a contact part 28 of the counterpart plug 12, and, on the other hand, it has a terminal segment 29 for the insulated end of an electric line 31, known per se and not shown in detail. The contact segment 26 and the terminal segment 29 are joined together by an intermediate segment 32 of the contact element 25.

The intermediate segment 32 is composed of a boxlike middle part 33, from which two detent tongues 34 acting as pullout security are levered out, which serve as a primary means of securing the contact element 25 against pullout from the receiving chamber 22, and a connecting locking part 35 that is constricted compared with the middle part 33 and the joining segment 29; the constriction of the locking part 35 serves to provide engagement from behind of a locking comb 36. Comb 36 is shown only schematically, and in a manner not shown in detail, is joined to the packing element 19 and forms a secondary means of securing against pullout of the contact element 25 from the receiving chamber 22.

The packing element 19 is formed as an uninterrupted encompassing rubber-elastic radial seal, adapted to the shape of the contact carrier 14, which is elongated as a result of the contact elements 25 disposed in a row. The packing element 19 has an in cross section approximately rectangular base, or basic body 37. This body is inserted with initial stress into notch 18 of the contact carrier 14 in order to support the packing element 19.

On an outer jacket face 38, the base, basic body 37 has uninterrupted, encompassing sealing beads 39 protruding from the jacket face 38 which, when the plug 11 is put together with the counterpart socket 12, are supported positively on the inside face 21 of the counterpart socket 12 and seal off the plug connection linearly at this point.

In association with each of the contact elements 25, the packing element 19 has two opposed, pinlike retaining segments 41 guided in the transverse bore 24. The retaining segments 41, which begin on one inside 42 of the basic body 37 and are oriented at right angles thereto and to the longitudinal axis 23, are so dimensioned in their length such that they rest resiliently on the locking part 36 and secure it in its position.

Alternatively, the retaining segments 41 and the associated transverse bores 24 in the contact carrier 14 may also be mounted in such a way that the retaining segments 41 support the intermediate segment 32 or the contact segment 26 of the contact element 25.

Alternatively, the cross-sectional face of the transverse bores 24 and of the retaining segments 41 may differ from the circular, although that is simple to produce, and may for instance be rectangularly recessed.

As a result of the special configuration of the packing element 19 with the retaining segments 41 joined to the basic body 37, which support the contact element 25 positively and clamp it between them, motions caused by shaking at the contact element 25 are prevented, or at least damped and, as a result, the relative motion between the contact element 25 and the contact part 28 of the counterpart socket 12 is reduced, thereby lessening the danger of premature wearing through of the contact surfaces of the contact element 25 and contact part 28.

The contact security of the plug connection, even in use in a motor vehicle, in whose operation severe shaking strains must be expected, is thus assured.

Various changes and modifications may be made within the scope of the inventive concept.

What is claimed is:

1. An electric plug connection comprising a plug (11) having a plug housing (13);

a counterpart socket (12), said plug housing (13) being dimensioned to be received in said counterpart socket (12) and defining an outer surface located within said counterpart socket;

a contact part (28) located in the counterpart socket;

a contact carrier (14) located in the plug housing and made of electrically insulating material, said contact carrier being formed with a receiving chamber (22);

a contact element (25) located in said chamber and supported therein;

a connection segment (29) including a contact segment (26) for connection to an electric line (31), electrically conductively and mechanically connectable via said contact segment (26) with the contact part (28) within the counterpart socket (12);

an intermediate segment (32) located between said connecting segment (29) and the contact segment (26) of the contact element (25); and a packing element (19) located in the plug (11) and, in connected or plugged-in state of the connection, coupling the plug (11) to the counterpart socket (12), wherein the packing element (19) includes an uninterrupted, circumferentially closed rubber-elastic element comprising a base body (37) circumferentially engaging the outer surface of the contact carrier (14), and a retaining segment (41) located and guided in a transverse bore (24) extending through the contact carrier (14).

2. The plug connection of claim 1, wherein the retaining segment (41), transversely to the longitudinal direction of the contact element (25), resiliently rests with a first side on the contact element and, with a second side, on the base body (37).

3. The plug connection of claim 1, wherein the retaining segment (41) rests on the intermediate segment (32) of the contact element (25).

4. The plug connection of claim 2, wherein the retaining segment (41) rests on the intermediate segment (32) of the contact element (25).

5. The plug connection of claim 1, wherein the base body (37) of said rubber-elastic element is formed with projecting beads (39) protruding from the outer circumferential surface thereof and, in plugged-in state of the connection, sealing the plug (11) to the counterpart socket (12).

* * * * *